1/28/86 XR 4,566,237

United States Patent [19]

Turner

[11] Patent Number: 4,566,237

[45] Date of Patent: Jan. 28, 1986

[54] ARMORED PANEL

[75] Inventor: Patrick E. Turner, Glendale, Ariz.

[73] Assignee: Goodyear Aerospace Corporation, Akron, Ohio

[21] Appl. No.: 483,345

[22] Filed: Apr. 8, 1983

[51] Int. Cl.[4] ..... E04B 1/18; E04H 9/10

[52] U.S. Cl. ..... 52/269; 52/806; 109/1 S; 109/79; 109/82; 428/911

[58] Field of Search ..... 52/267, 268, 269; 89/36 A, 36 H; 109/1 S, 49.5, 58, 78, 79, 80, 82, 84; 428/73, 116, 118, 911

[56] References Cited

U.S. PATENT DOCUMENTS

| | | | |
|---|---|---|---|
| 2,380,393 | 7/1945 | Berg | 89/36 A |
| 3,351,374 | 11/1967 | Forsyth et al. | 89/36 A |
| 3,577,836 | 5/1971 | Tamura | 428/911 |
| 3,604,374 | 9/1971 | Matson | 109/49.5 |
| 3,699,842 | 10/1972 | Grewing et al. | 89/36 H |
| 3,994,105 | 11/1976 | Jamison et al. | 52/267 |
| 4,323,000 | 4/1982 | Dennis et al. | 89/36 A |
| 4,351,558 | 9/1982 | Mueller | 89/36 H |
| 4,404,889 | 9/1983 | Miguel | 428/911 |

OTHER PUBLICATIONS

Du Pont, Kevlar Aramid, Nov. 1982, pp. 1-11.

*Primary Examiner*—Stephen C. Bentley.
*Attorney, Agent, or Firm*—L. A. Germain; P. E. Milliken

[57] ABSTRACT

An armored panel construction for a shelter to defeat ballistic fragment and thermal radiation threats comprises an inner structural panel of aluminum alloy sheets bonded to a honeycomb core and an outer face panel of an aramid fiber fabric in a multi-ply resin matrix laminate. The face panel is in a specific spaced relationship to the inner structural panel such that the energy of an impacting projectile is distributed over a large area and the face panel is allowed to flex inwardly in the absorption of such energy.

7 Claims, 1 Drawing Figure

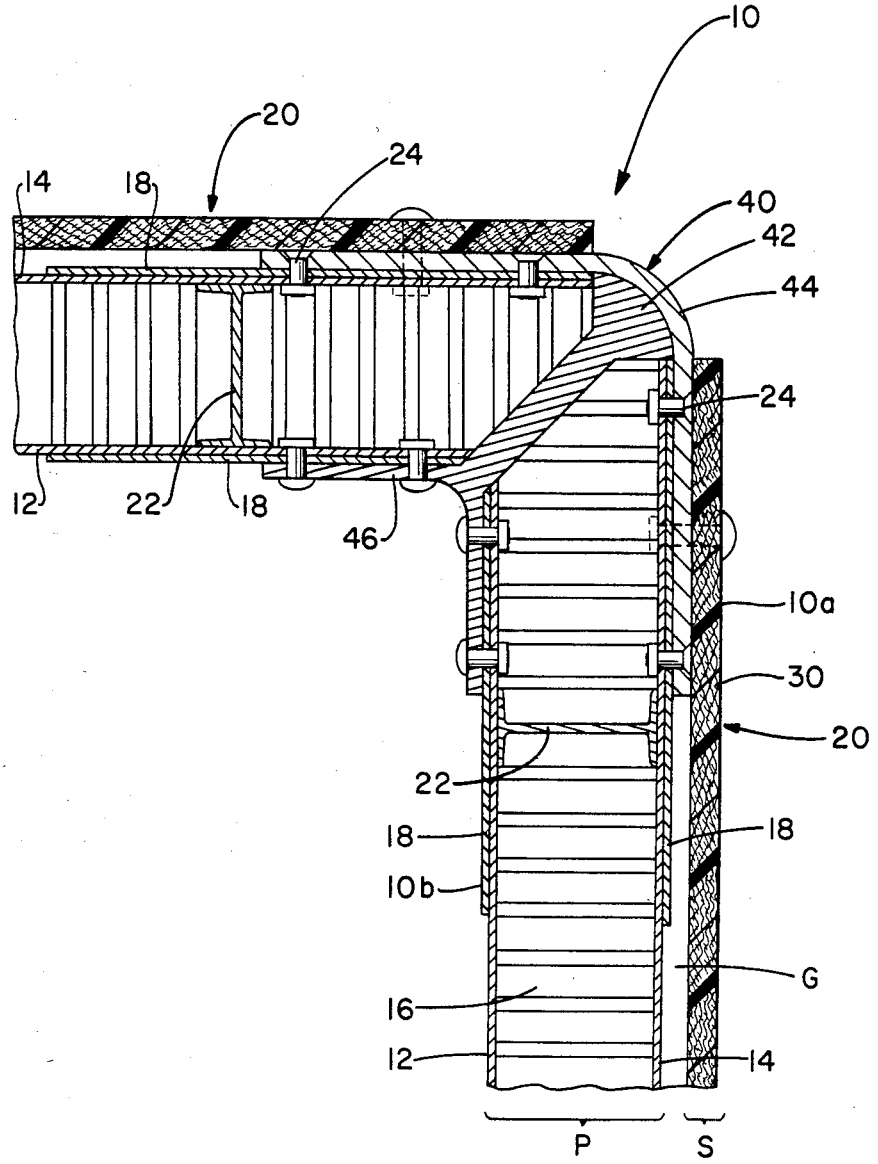
10
20
24
14
18
40
42
44
24
12
22
18
46
10a
30
20
22
18
18
10b
G
16
12
14
P
S

ARMORED PANEL

BACKGROUND OF THE INVENTION

This invention generally relates to protective armor and more particularly to a lightweight armor system configuration for tactical shelters to defeat both ballistic and thermal radiation threats to the security of the shelter and its occupants.

Personnel shelters have been made for various commerical and military applications and they have been manufactured to specific size and shape configurations so as to be suitable for airlift to remote areas of the world. Shelters of the type alluded to are designed for use as field offices, photo and/or data processing labs, communication control centers, machine tool shops and the like. Because the shelters are generally used in foreign countries where they may be subjected to threats which tend to compromise their security, attempts are being made to armor them against such threats. These attempts are directed to armoring the shelter against both ballistic and thermal radiation threats while also attempting to keep the overall weight within acceptable limits.

SUMMARY OF THE INVENTION

This invention is directed to a configuration for a shelter panel construction that meets the weight requirements imposed on such shelters while also being capable of defeating a ballistic threat due to exploded fragment exposure and of defeating a thermal threat due to possible nuclear radiation exposure.

A ballastic threat, within the context of this invention, is defined as an irregularly-shaped, non-pointed projectile having an impact energy of not more than 300 ft-lbs. The armored panel of this invention is configured such that the projectile will not penetrate the inner wall of the shelter.

Therefore, and in accordance with the teachings of this invention, an armored panel configuration is provided that meets the needs of the art and comprises in combination.

an inner structural panel comprised of first and second aluminum alloy sheets bonded to a honeycomb core; and an outer face panel comprised of a multi-ply laminate of a woven roving aramid fiber fabric in a resin matrix, said face panel mechanically attached to the second aluminum sheet in a manner such that a predetermined gap exists between the two and the face panel flexes inwardly upon being impacted.

BRIEF DESCRIPTION OF THE DRAWING

The single FIGURE of the drawing is a horizontal section through one corner of a personnel shelter showing a various plies of the panel construction according to this invention.

DETAILED DESCRIPTION OF THE INVENTION

With reference to the drawing, a configuration for an armored panel shelter structure is generally indicated by reference numeral 10. The drawing is a horizontal section through vertical panels forming the walls of the shelter structure 10, the section being taken at one corner thereof and the outward facing surface being indicated at 10*a* while the inward facing surface is indicated at 10*b*. The structure 10 comprises vertical wall panels generally indicated at 20 which are jointed at corner assemblies generally indicated at 40. More specifically, the walls 20 comprise a structural panel "P" and a shield panel "S" separated by a gap "G".

The structural panel designated "P" comprises an inner aluminum alloy lamina, ply, or sheet 12, and an outer aluminum alloy lamina, ply, or sheet 14 separated by an intermediate core 16, the three elements 12, 14 and 16 being bonded together to form an integral composite structure. The core 16 is preferably a medium-to-heavy gauge Kraft paper hexogonal honeycomb. For the purpose of economy, the core 16 may also comprise an aluminum honeycomb. Further, the core 16 may also comprise an aramid honeycomb such as, for example, a NOMETX TM honeycomb which will provide a fire resistant structure but at a much higher cost. In any event, the choice of materials will depend upon the designed weight and utility criteria for a structure being made from such panels. It is anticipated that vertical wall panels of the type described will be constructed within the weight range of 1.5–3.5 pounds per square foot. The "P" panels also include aluminum alloy edge doubler plies 18 on the outward and inward facing peripheral edge surfaces thereof and a limited number of reinforcement beams 22 positioned within the core 16. The total panel thickness, ply gauge, core density, and doublers (size and gauge) are, of course, chosen in accordance with a specific design load distribution for a completed structure.

TM DuPont Company, Wilmington, DE

The shield panel designated "S" is a multi-ply composite laminate indicated generally by reference numeral 30. The laminate 30 comprises an aramid fiber fabric in a resin matrix and preferably comprises at least seven piles of twenty-ounce per square yard woven roving aramind fiber fabric in a ten percent resin matrix. A ballistic grade fabric of KEVLAR TM aramid fiber has proven to be an effective shield panel in this application. The resin may be any suitable epoxy, polyester, or polyvinyl butyl resin and a completed laminate 30 will have a thickness within the range of 5–8 mm (0.2–0.3 inches).

TM DuPont Company, Wilmington, DE

The bonded structural panels designated "P" are assembled to form a shelter structure by means of a framework comprising a plurality of corner assemblies 40. Each assembly 40 comprises an aluminum alloy corner extrusion 42 and an outer aluminum alloy cap angle member 44. The extrusion 42 also includes an interior cove angle portion 46 that forms an integral part of the total extrusion 42. The "P" panels are mechanically fastened into the corner extrusions 42 by rivets, bolts, or screws 24 in the area of the edge doublers 18 and cap angle 44. The shield panel "S" is mechanically fastened to the outside of the "P" panel but it is positioned on top of the cap angle 44 such that a gap "G" is created between the "P" and "S" panels. The gap "G" is important to the ballistic and thermal performance of the structure in that it allows the fabric laminate 30 to flex inwardly upon impact by an exploded fragment and/or thermal radiation threat. For example, it has been verified that for the same material structural elements for the "P" and "S" panels, a gap of "zero" clearance between the panels in ineffective in stopping a ballistic fragment having an energy of 300 ft-lbs. However, when the gap "G" exists and is at least 1.58 mm (0.0625 inches) such projectile will not penetrate the wall structure 30. While it is anticipated that the gap will exist primarily as an air space between the "P" and "S" panels, there may be some instances where spacer members will be required to maintain the gap distance. For example, for very large area panels a cellular foam spacer or furring strip may be inserted between the "P" and "S" panels to maintain the gap "G" while at the same time providing sufficient compression so as to allow flexure of the laminate 30.

It will be appreciated that similar panels may be used to construct the roof of the shelter, however because the ballistic and thermal radiation threats will normally come in a substantially horizontal direction, it is anticipated that the roofing panels will be of lighter weight. For example, the vertical wall panels may be constructed such that a wall panel weight is within the range of 1.5 lbs/sq. ft. to 3.5 lbs/sq. ft. Roofing panels may therefore be constructed so as to be at the low end of the weight range. The corner assemblies may also be made to be within the range of 2 lbs/lineal ft. to 5.5 lbs/lineal ft.

In accordance with the teaching of this invention, ballistic tests of an 18 inch by 18 inch square "S" panel of 12 ply woven roving aramid fiber fabric in a resin matrix laminate positioned and spaced from a "P" panel with a gap of 0.125 inches between them was effective in defeating a 60-grain cylindricallyshaped steel projectile with a nominal hardness of 33 on the Rockwell "C" hardness scale. The projectile simulated a ballistic fragment having length and diameter dimensions of 0.334 inches respectively and no penetration of the structure by the projectile was accomplished.

While a single embodiment of the invention has been illustrated and described in detail, it is to be understood that the invention is not limited thereto or thereby, but that various modifications may become apparent to those persons skilled in the art and these are considered to fall within the scope of the appended claims.

I claim:

1. A configuration for a lightweight and portable shelter having wall and roof panels armored against ballistic fragment and thermal radiation threats comprises in combination:

vertical and horizontal aluminum alloy corner extrusions defining a cove angle at an inward extent and forming a skeleton framework of the shelter;

inner structural panels supported in the corner extrusions, said structural panels comprising inward and outward facing aluminum alloy sheets bonded to a lightweight honeycomb core, the inward facing sheet mechanically fastened to the cove angle in the corner extrusion;

an extruded aluminum alloy cap angle mechanically fastened to the outward facing sheet of the inner structural panel and covering the corner extrusions forming the framework; and an outer face panel comprised of a multi-ply laminate of at least seven plies of an aramid fiber fabric in a resin matrix, said face panel overlapping and mechanically fastened to the cap angle extrusion such that a gap of at least 1.5 mm (0.6 inch) is defined as between the face panel and the outward facing aluminum sheet of the inner structural panel.

2. The shelter as set forth in claim 1 wherein the structural panels include aluminum extruded beam reinforcements within the core between the inward and outward facing sheets.

3. The shelter as set forth in claim 1 wherein the honeycomb core comprises a Kraft paper honeycomb.

4. The shelter as set forth in claim 1 wherein the face panel comprises a laminate of at least seven plies of 20 oz/sq yd woven roving aramid fiber fabric in a ten percent content resin matrix.

5. The shelter as set forth in claim 1 wherein the corner extrusions and cap angle combined do not exceed 5.5 pounds per lineal foot in weight and the structural panels and face panels combined do not exceed 3.5 pounds per square foot in weight.

6. The shelter as set forth in claim 1 wherein the gap between the structural and face panels is at least 0.125 inch.

7. The shelter as set forth in claim 1 wherein the face panel comprises a laminate of 12 plies of woven roving aramid fiber fabric in a ten percent resin content matrix structural panel and outer face panel is within the range of 1.5 mm–9.5 mm (0.0626–0.375 inch).

* * * * *

UNITED STATES PATENT AND TRADEMARK OFFICE

CERTIFICATE OF CORRECTION

PATENT NO. : 4,566,237

DATED : January 28, 1986

INVENTOR(S) : Patrick E. Turner

It is certified that error appears in the above-identified patent and that said Letters Patent is hereby corrected as shown below:

Claim 1, at column 4, line 18, "0.6 inch" should read -- .06 inch --.

Claim 7, at column 4, line 41, a period should be placed after "matrix" and lines 42 and 43 should be deleted.

Signed and Sealed this

*Fifteenth* Day of *April 1986*

[SEAL]

*Attest:*

DONALD J. QUIGG

*Attesting Officer*

*Commissioner of Patents and Trademarks*